US006721970B1

(12) United States Patent
Cheng

(10) Patent No.: US 6,721,970 B1
(45) Date of Patent: Apr. 20, 2004

(54) FOOT OF A BABY BED

(76) Inventor: Pao-Hsien Cheng, No. 139, Jen Yi 1st Street, Jen Te Hsiang, Tainan Hsien (TW)

( * ) Notice: Subject to any disclaimer, the term of this patent is extended or adjusted under 35 U.S.C. 154(b) by 0 days.

(21) Appl. No.: 10/265,625

(22) Filed: Oct. 8, 2002

(51) Int. Cl.[7] ..... A47D 13/06

(52) U.S. Cl. ..... 5/99.1; 5/312; 5/93.1; 16/30

(58) Field of Search ..... 16/30; 5/312, 99.1, 5/660, 509.1, 106, 107, 93.1, 201, 285

(56) References Cited

U.S. PATENT DOCUMENTS 1,530,116 A * 3/1925 Hawkins ..... 5/98.3
3,105,976 A * 10/1963 Roche ..... 5/285
4,913,452 A * 4/1990 Zun ..... 280/47.41
5,956,786 A * 9/1999 Huang ..... 5/105
6,158,067 A * 12/2000 Cheng ..... 5/106

* cited by examiner

*Primary Examiner*—Michael F. Trettel
(74) *Attorney, Agent, or Firm*—Rosenberg, Klein & Lee

(57) ABSTRACT

A baby bed has feet connected to lower ends of vertical supporting legs. Each of the feet has an upper fixed part, which is joined to corresponding leg when the baby bed is assembled in the factory, and a lower part, which is to be fitted to the upper part later by the user for the baby bed to be used. The upper part has elongated protrusions formed along the bottom, and the lower part has corresponding trenches on the top so that the lower part can be fitted to the upper part with the trenches being mounted onto the protrusions. All of the lower parts of the feet are placed in spare space of a packing box to save space in storage and transportation when the baby bed is folded and put in the box after assembling.

10 Claims, 6 Drawing Sheets

FOOT OF A BABY BED

BACKGROUND OF THE INVENTION

1. Field of the Invention

The present invention relates to a foot set of a baby bed, more specifically a foot set, which is structured such as to help reduce size of packing; the foot set includes a plurality of feet each having an upper part attached to the frame of a baby bed, and a lower part, which is separate from the upper part. The lower parts may be packed in spare spaces of a packing box of the baby bed until the baby bed is unpacked and stretched to be used.

2. Prior Art

The present applicant has disclosed many inventions on baby bed products, which include cribs and playpens for babies, up to now. Examples include U.S. Pat. No. 6,364,563 directed to a Joint for a playpen, and U.S. patent application Ser. No. 09/859,382.

Most of the above inventions are aimed at providing the users with more convenience and safety in use. Although most of the above baby beds and playpens are structured to be foldable for saving space in storage and transportation after assembly in the factory, little effort has been made to further reduce dimensions of the products when fully collapsed. Because the dimensions of the products when fully collapsed are not reduced to an ideal degree, there remains room for further reduction of such dimensions of baby bed products to reduce storage and transportation costs.

SUMMARY OF THE INVENTION

It is a main object of the present invention to provide a foot set for a baby bed, which is structured in such manner that a packing box for the baby bed may be provided with reduced size for allowing easy storage and transportation.

The feet are connected to lower ends of vertical supporting legs of a baby bed. Each of the feet has an upper fixed part, which is joined to a corresponding leg when the baby bed is assembled in the factory, and a lower part. Each of the upper parts has elongated guide rails formed along its bottom, and each of the lower parts has corresponding trenches formed on its top. The elongated guide rails and trenches have corresponding inverted T shaped cross-sections so that the lower part can be joined to the upper part with the guide rails being slid into the trenches.

All of the lower parts of the feet are initially disposed separate from the upper parts, and arranged in spare spaces of a packing box to save space for storage and transportation when the baby bed is folded and put in the box after factory assembly.

Each of the elongated guide rails has a hook hole at a bottom thereof, and each of the trenches has an engaging hook formed therein. The engaging hooks snap into the hook holes of the corresponding fixed upper parts when the lower parts of the feet are fitted in position, preventing the lower parts from separating from the fixed upper parts.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
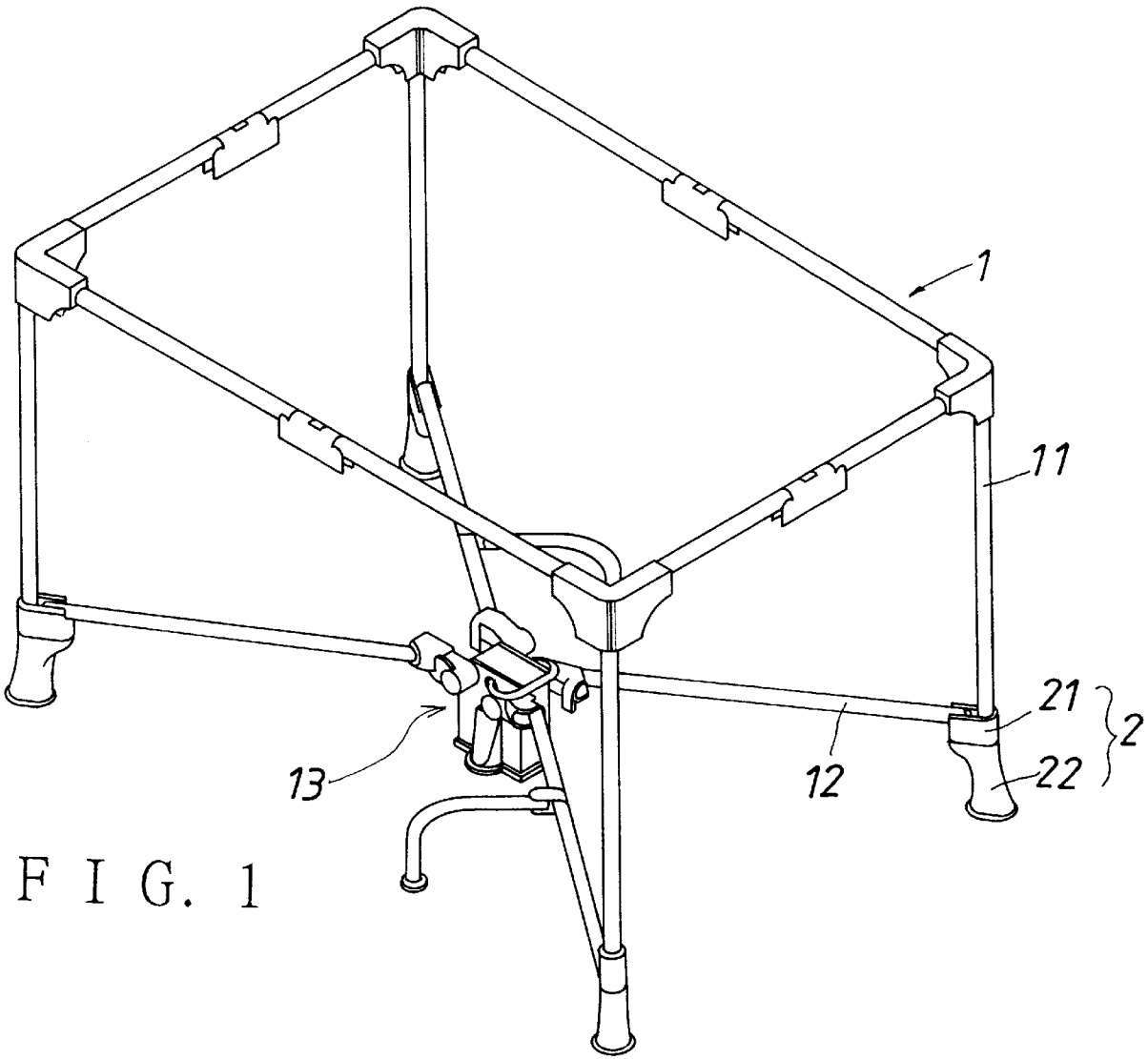
FIG. 1 is a perspective view of a baby bed apparatus in a stretched position with assembled feet according to a first embodiment of the present invention.
Figure 2:
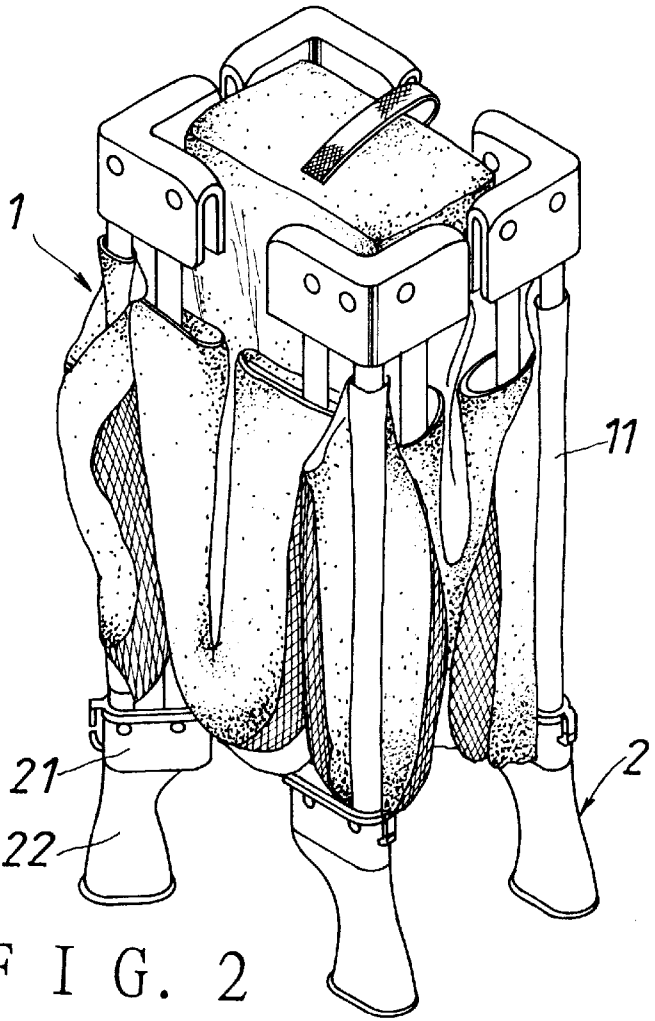
FIG. 2 is a perspective view of a baby bed apparatus in a folded position with assembled feet according to a first embodiment of the present invention.
Figure 3:
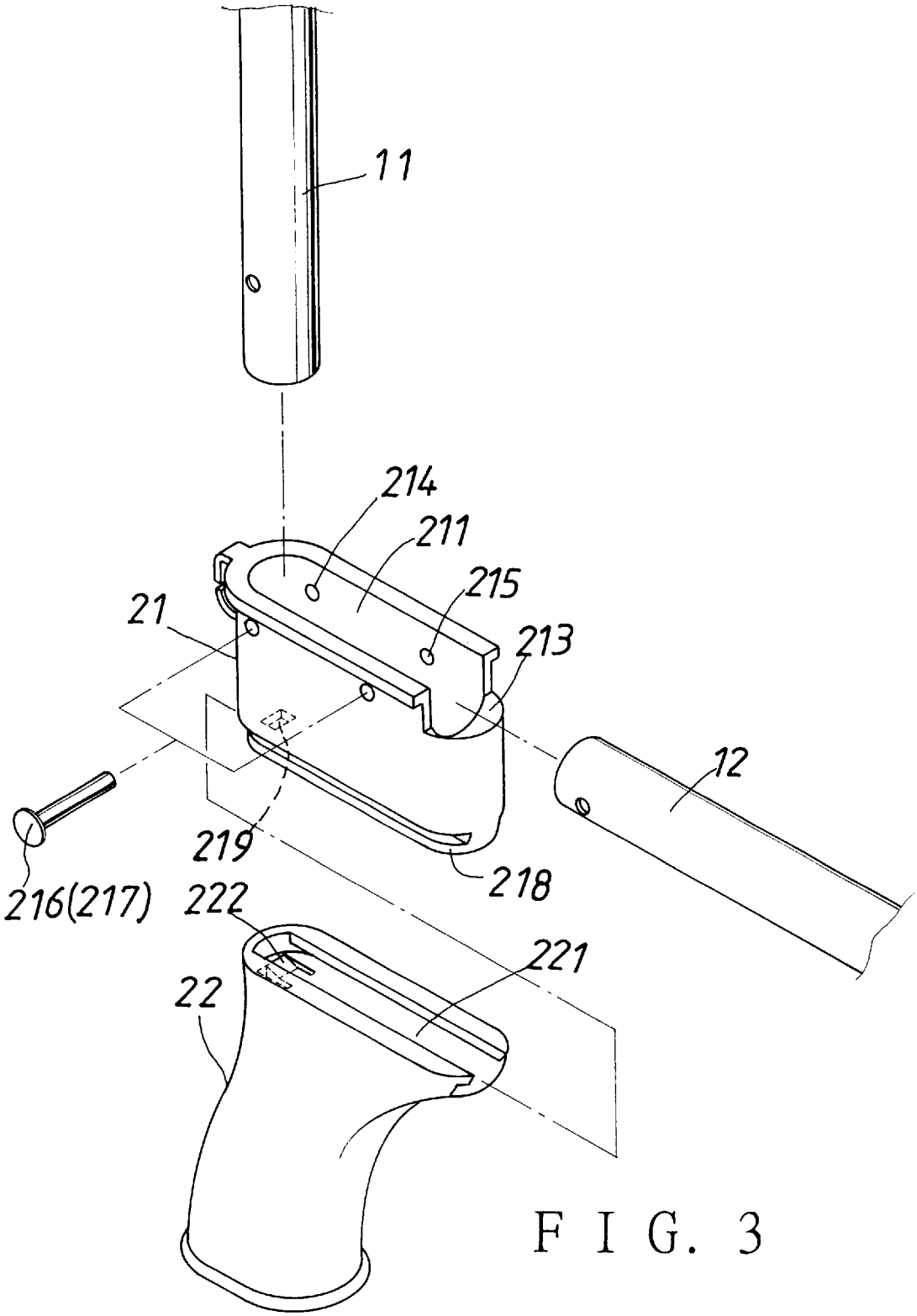
FIG. 3 is an exploded perspective view of a foot of a baby bed according to a first embodiment of the present invention.

Referring to FIGS. 1, 2, and 3, a foot set of a baby bed according to a first embodiment of the present invention includes four feet 2, each of which consists of a fixed upper part 21 and a lower part 22.

The foot set is to be used on a baby bed apparatus, which has a frame 1 consisting of four upper horizontal rods, four vertical rods 11, four lower horizontal rods 12, and a supporting base 13.

Referring to FIGS. 2 and 3, which shows the first embodiment of the invention, each of the fixed upper parts 21 is joined to a corresponding vertical rod 11, and a corresponding lower horizontal rod 12 of the baby bed frame 1. Each of the fixed upper parts 21 has a holding room 211, a gap 213, a pair of first aligned through holes 214, and a pair of second aligned through holes 215. Lower ends of the vertical rods 11 are respectively inserted into connecting compartments 212 (FIG. 4) of the holding rooms 211; and, connecting pins 216 are passed through the first through holes 214 of the fixed upper parts 21, and holes (not numbered) of the rods 11. Outer ends of the lower horizontal rods 12 of the frame 1 are passed through the gaps 213, and connecting pins 217 are passed through both the second through holes 215 of the fixed upper parts 21 and corresponding holes of the horizontal rods 12. Inner ends of the horizontal rods 12 are joined to the supporting base 13.

Figure 6:
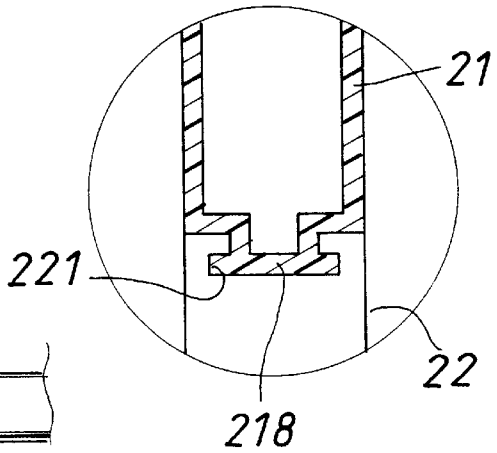
FIG. 6 is another cross-sectional view of a portion of the foot of a baby bed of the first embodiment of the present invention.

Furthermore, each of the fixed upper parts 21 has an elongated guide rail 218 along a bottom thereof. A hook hole 219 is formed in each elongated guide rail 218. The guide rails 218 can be made to have an inverted T-shaped cross-section as shown in FIG. 6.

Each of the lower parts 22 has an elongated guide trench 221 on an upper side, and an engaging hook 222 in the guide trench 221 thereof. The guide trenches 221 are made to have a complementary inverted T-shaped cross-section as shown in FIG. 6.

When the baby bed is put in a packing box after production and assembly in factories, the lower parts 22 are disposed separate from the fixed upper parts 21, and arranged in spare spaces of the packing box together with the frame 1. Thus, the height of the packing box can be reduced for easy storage and transportation, for instance.

Figure 5:
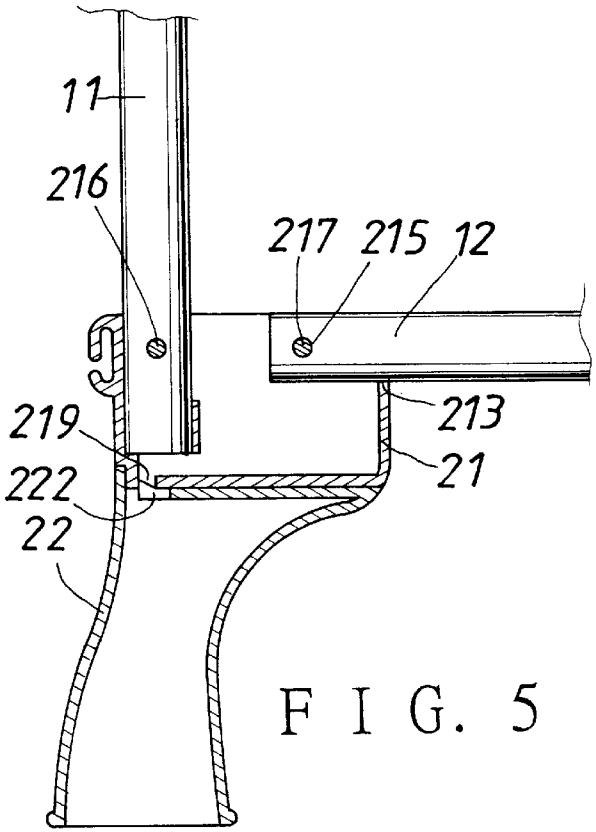
FIG. 5 is a cross-sectional view of the foot of a baby bed of the first embodiment of the present invention after full assembly by a user.
Figure 4:
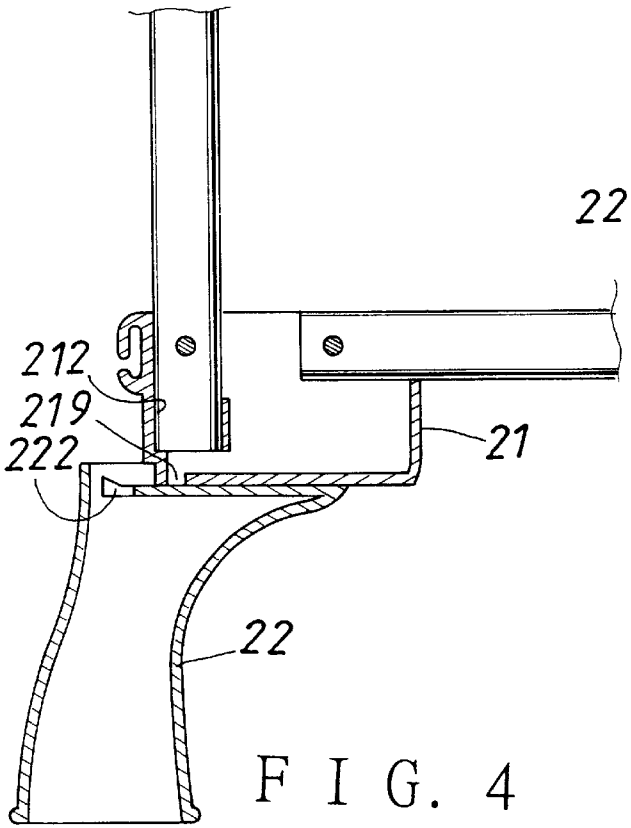
FIG. 4 is a cross-sectional view of the foot of a baby bed of the first embodiment of the present invention during assembly by a user.

When the baby bed is unpacked and stretched to be used, referring to FIGS. 4, and 5, the lower parts 22 are joined to respective fixed upper parts 21 by sliding the tops of the lower parts 22 along the bottoms of the fixed upper parts 21 so as to mount the elongated guide trenches 221 onto the elongated guide rails 218. The engaging hooks 222 will snap into the hook holes 219 of the fixed upper parts 21 when the lower parts 22 are slid fully into position, preventing the lower parts 22 from separating from the fixed upper parts 21. Usually, users don't have to pack the baby bed again after unpacking it for use; therefore, each foot is structured such that the lower part 22 cannot be separated from the fixed upper part 21 once attached to the upper part 21.

Figure 7:
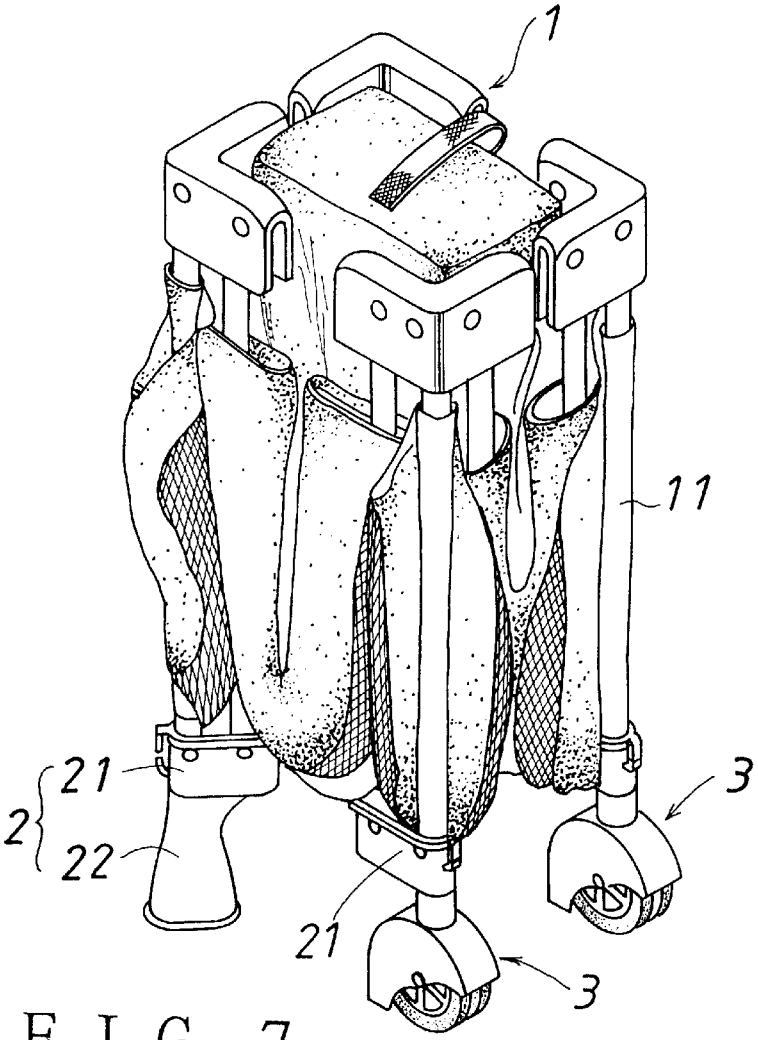
FIG. 7 is a perspective view of a baby bed in folded position with wheeled feet of a second embodiment of the present invention.
Figure 8:
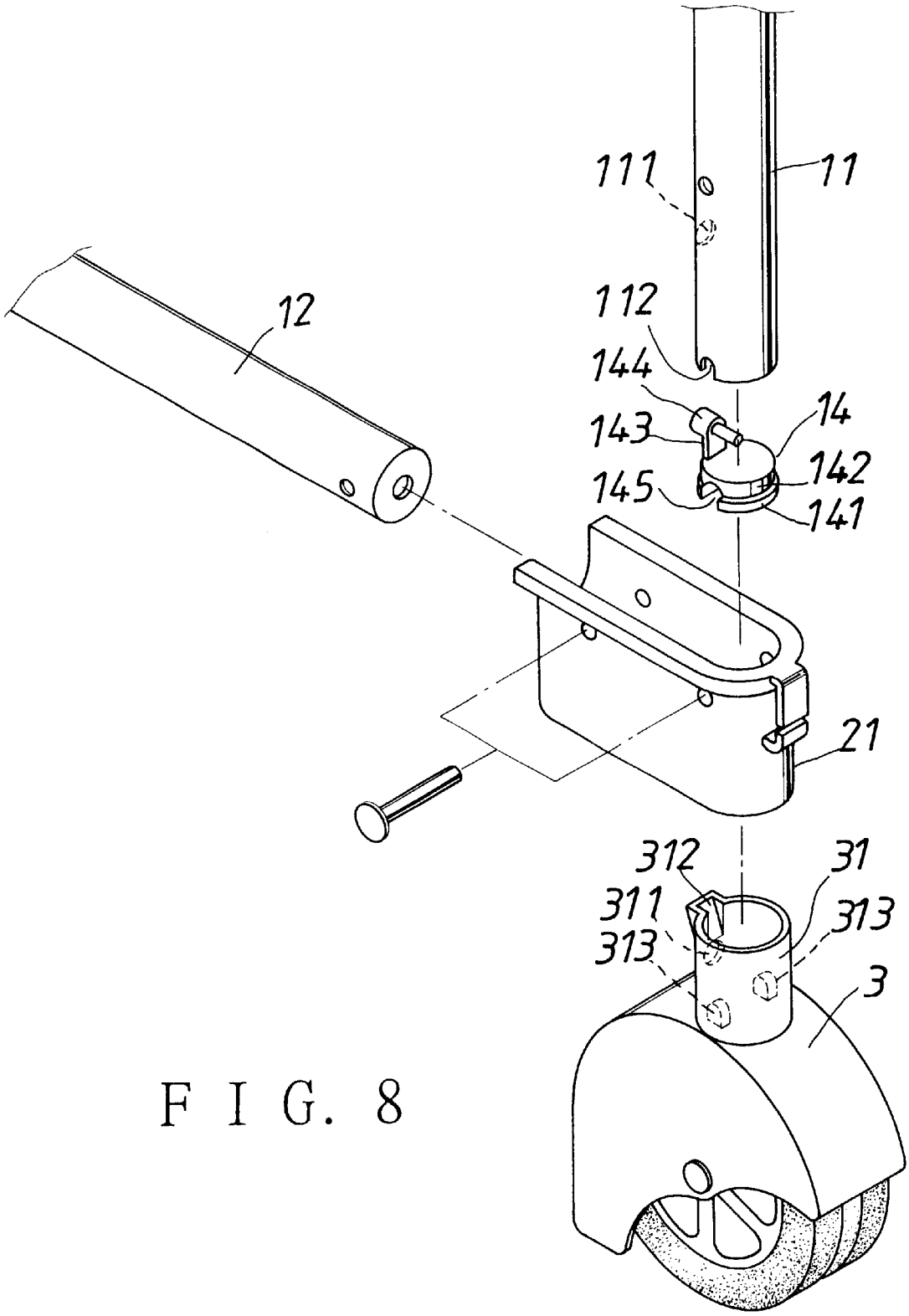
FIG. 8 is an exploded perspective view of the wheeled foot of a baby bed according to the second embodiment of the present invention.
Figure 10:
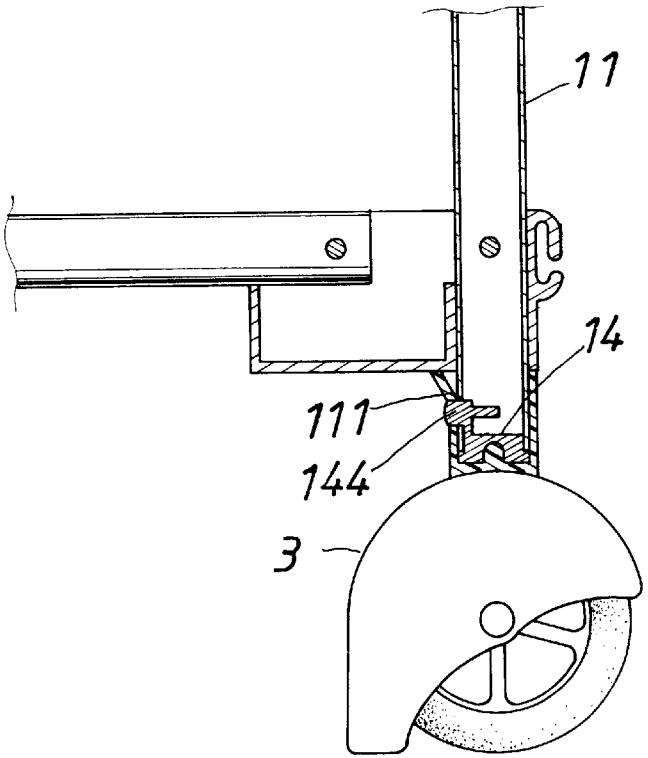
Figure 9:
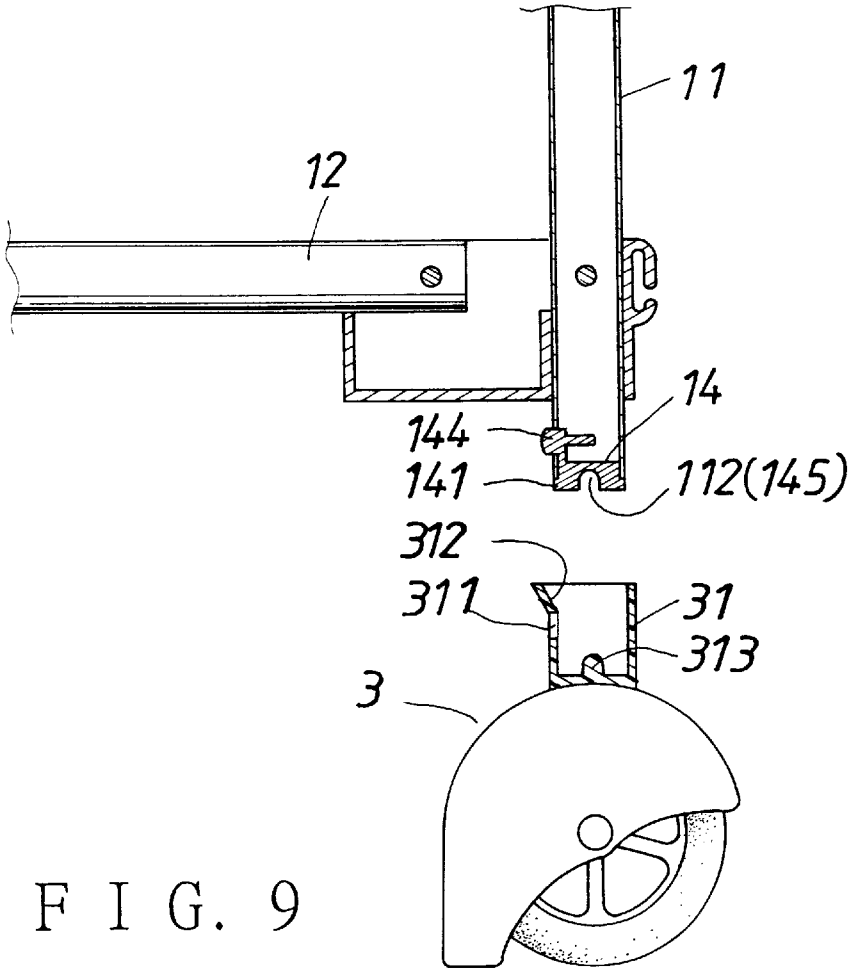
FIG. 9 is a cross-sectional view of the wheeled foot of a baby bed according to the second embodiment of the present invention during assembly by a user; and, FIG. 10 is a cross-sectional view of the wheeled foot of a baby bed according to the second embodiment of the present invention after full assembly by a user.

Referring to FIGS. 7 and 8, which show a second embodiment of the invention, the foot set includes a pair of first feet, which are the same as the feet of the first embodiment, and a pair of second feet, which have wheeled lower parts 3 instead of the lower parts 22 of the first feet that are provided for preventing the baby bed from slipping during use. Each of the second feet further has an upper fixed part 21, which is different from the fixed upper parts 21 of the first feet. In addition, each of the vertical rods 11 to be joined to the second feet has formed therein a lateral engaging hole 111.

In the second embodiment, the fixed upper parts 21 of the second feet are joined to corresponding vertical rods 11, and corresponding lower horizontal rods 12. The lower end of each of the vertical rods 11 has two engaging gaps 112. Two engaging elements 14 are provided, each of which has an upper portion 142, and a lower portion 141 diametrically wider than the inner diameter of the vertical rods 11. Each of the engaging elements 14 has engaging gaps 145 formed on its bottom, and a flexible plate 143, which extends up from the upper side, and which has an engaging projection 144 formed on an upper end of an outward side thereof.

Each of the wheeled lower parts 3 includes a wheel supporting member having a connecting tube 31. Each of the connecting tubes 31 has a lateral engaging hole 311, a guiding slope 312 on an inner side above the engaging hole 311, and two engaging posts 313 protruding therefrom.

In combination, the upper portions 142 of the engaging elements 14 are inserted into lower ends of corresponding vertical rods 11 with the engaging projections 144 extending out through the lateral engaging holes 111. The engaging gaps 145 are aligned with the engaging gaps 112 of the vertical rods 11; and, the lower portions 141 are kept under the lower ends of the corresponding vertical rods 11 because they are wider than the vertical rods' inner diameters.

When the baby bed is put in a packing box after production and assembly in factories, the respective wheeled lower parts 3 and the lower parts 22 are disposed separate from the fixed upper parts 21, 21 of the first and second feet and arranged in spare spaces of the packing box together with the frame 1. When the baby bed is unpacked and stretched to be used, the vertical rods 11 with the engaging elements 14 are inserted into corresponding tubes 31 so that the engaging projections 144 also extend out from the lateral engaging holes 311 of the tubes 31. Thus, the wheeled lower parts 3 are joined to the vertical rods 11. The guiding slopes 312 serve to guide the engaging projections 144 into the lateral holes 311 during this assembly process. The engaging gaps 112, 145 are mounted on the engaging posts 313 to help prevent the vertical rods 11 from moving relative to the wheeled lower parts 3.

From the above description, it can be easily understood that the foot set of a baby bed of the present invention has an advantage in that the lower parts thereof can be disposed separate from the baby bed frame, and arranged in spare spaces of a packing box holding the frame. Therefore, a packing box for the baby bed may be of reduced size, saving space in storage and transportation.

What is claim is:

1. A foot set of a baby bed, comprising:

a plurality of feet each including:

(i) a fixed upper part joined to a corresponding vertical rod and a corresponding lower horizontal rod of a frame of a baby bed; and, (ii) a lower part provided for supporting the baby bed on a ground; the lower part being separate from the frame of the baby bed, and put in spare space of a packing case of the baby bed; the lower part being disposed under the fixed upper part when the baby bed is unpacked to be used;

wherein the baby bed frame has a plurality of vertical rods, and a plurality of lower horizontal rods, each of the fixed upper parts having an elongated guide rail along a bottom thereof, and each of the lower parts having an elongated guide trench on an upper side thereof, the lower parts of the feet being joined to respective ones of the fixed upper parts by sliding the lower parts on the fixed upper parts to mount the elongated guide trenches onto the elongated guide rails.

2. The foot set of a baby bed as claimed in claim 1, wherein each of the elongated guide rails has a hook hole on a bottom thereof, and each of the elongated guide trenches has an engaging hook therein; the engaging hooks snapping into the hook holes of the fixed upper parts when the lower parts of the feet are fitted in position, preventing the lower parts from separating from the fixed upper parts when the lower parts are joined to the fixed upper parts.

3. The foot set of a baby bed as claimed in claim 1, wherein each of the elongated guide rails are made to have an inverted T-shaped cross-section, and the elongated guide trenches corresponding in shape to the elongated guide rails.

4. The foot set of a baby bed as claimed in claim 1, wherein the baby bed frame has four vertical rods, and four lower horizontal rods, and the feet includes a pair of side-by-side arranged first feet, the lower parts thereof being shaped in such a manner as to prevent the baby bed from slipping, and a pair of side-by-side arranged second feet, the lower parts thereof being equipped with wheels for allowing the baby bed to be easily movable.

5. The foot set of a baby bed as claimed in claim 4, wherein lower ends of the vertical rods joined to the second side-by-side arranged feet are passed through the fixed upper parts, and are each connected to an engaging element, and each of the wheels has a supporting member including a tube; each of the engaging elements having a flexible plate extending out from corresponding lateral holes of the vertical rods at an engaging projection of the flexible plate; each of the tubes having a lateral engaging hole; the lower ends of the vertical rods joined to the pair of second feet being inserted into the tubes of the supporting members of the wheels with the engaging projection of the flexible plate snapping into the lateral engaging hole to secure the wheels to the vertical rods.

6. The foot set of a baby bed as claimed in claim 5, wherein each of the engaging elements is formed with an upper portion and a lower portion extending radially outward therefrom the upper portion being inserted into the lower end of the corresponding vertical rod, and the lower portion engaging the lower ends of the corresponding vertical rod in axially stopped manner.

7. The foot set of a baby bed as claimed in claim 5, wherein each of the tubes of the supporting members of the wheels has a guiding slope on an inner side above the lateral engaging hole thereof for guiding the engaging projections of the corresponding flexible plate into the lateral engaging hole.

8. The foot set of a baby bed as claimed in claim 5, wherein gaps are formed on lower ends of the engaging elements and the vertical rods joined to the pair of second feet, and engaging posts are formed in the tubes of the supporting members of the wheels; the gaps engaging on the engaging posts to secure connection of the vertical rods with the wheels.

9. The foot set of a baby bed as claimed in claim 4, wherein each of the fixed upper parts of the pair of first feet has an elongated guide rail along a bottom thereof, and each of the lower parts of the pair of first feet has an elongated guide trench on an upper side thereof; the lower parts of the feet being joined to respective ones of the fixed upper parts by means of sliding the lower parts along the fixed upper parts to mount the elongated guide trenches onto the elongated guide rails.

10. The foot set of a baby bed as claimed in claim 9, wherein each of the elongated guide rails has a hook hole on a bottom thereof, and each of the elongated guide trenches has an engaging hook therein; the engaging hooks snapping into the hook holes of the fixed upper parts when the lower parts of the feet are fitted in position, preventing the lower parts from separating from the fixed upper parts.

* * * * *